US012765605B2

(12) United States Patent
Chen

(10) Patent No.: US 12,765,605 B2
(45) Date of Patent: Oct. 20, 2026

(54) ATOMIZATION ASSEMBLY FOR USE IN ELECTROMAGNETIC HEATING DEVICE

(71) Applicant: SHENZHEN HUACHENGDA PRECISION INDUSTRY CO. LTD., Shenzhen (CN)

(72) Inventor: Ping Chen, Shenzhen (CN)

(73) Assignee: SHENZHEN HUACHENGDA PRECISION INDUSTRY CO. LTD., Shenzhen (CN)

( * ) Notice: Subject to any disclaimer, the term of this patent is extended or adjusted under 35 U.S.C. 154(b) by 391 days.

(21) Appl. No.: 18/572,794

(22) PCT Filed: Oct. 13, 2021

(86) PCT No.: PCT/CN2021/123486

§ 371 (c)(1),
(2) Date: Dec. 21, 2023

(87) PCT Pub. No.: WO2023/050478

PCT Pub. Date: Apr. 6, 2023

(65) Prior Publication Data

US 2024/0215646 A1 Jul. 4, 2024

(30) Foreign Application Priority Data

Sep. 29, 2021 (CN) ..... 202111151969.5

(51) Int. Cl.
*A24F 40/465* (2020.01)
*A24F 40/10* (2020.01)
(Continued)

(52) U.S. Cl.
CPC ..... *A24F 40/465* (2020.01); *A24F 40/10* (2020.01); *A24F 40/485* (2020.01); *A24F 40/95* (2020.01); *A24F 40/57* (2020.01)

(58) Field of Classification Search
None
See application file for complete search history.

(56) References Cited

FOREIGN PATENT DOCUMENTS

CN 207492079 U 6/2018
CN 111671165 A 9/2020
(Continued)

OTHER PUBLICATIONS

1 International Search Report of PCT Patent Application No. PCT/CN2021/123486 issued on Jun. 24, 2022.

*Primary Examiner* — Phu H Nguyen
(74) *Attorney, Agent, or Firm* — Andrew C. Cheng

(57) ABSTRACT

An atomization assembly for use in an electromagnetic heating device, includes an atomization apparatus (10) and a heating apparatus (20). The atomization apparatus (10) comprises a magnetically conductive metal part (12). The heating apparatus (20) comprises, a circuit board (22), a power battery (23) and a coil assembly (24). The power battery (23) is connected to the coil assembly (24) by means of the circuit board (22). The coil assembly (24) is provided with an accommodating space (241). The magnetically conductive metal part (12) is located in the accommodating space (241). The present invention applies power battery (23) heating to the electronic atomization field, and the magnetically conductive metal part (12) requires no conductive lines connected thereto, and both the structural strength and the material of the magnetically conductive metal part (12) can be made with an optimal design and the utilization of thermal energy is made high.

8 Claims, 12 Drawing Sheets

(51) Int. Cl.

| | |
|---|---|
| ***A24F 40/485*** | (2020.01) |
| ***A24F 40/57*** | (2020.01) |
| ***A24F 40/95*** | (2020.01) |

(56) References Cited

FOREIGN PATENT DOCUMENTS

| | | | |
|---|---|---|---|
| CN | 211431092 | U | 9/2020 |
| CN | 213074430 | U | 4/2021 |
| CN | 112772991 | A | 5/2021 |
| JP | 3001285 | U | 8/1994 |
| JP | 2009276034 | A | 11/2009 |
| JP | 2019500019 | A | 1/2019 |
| JP | 2019525737 | A | 9/2019 |
| WO | 2012002296 | A1 | 1/2012 |

ATOMIZATION ASSEMBLY FOR USE IN ELECTROMAGNETIC HEATING DEVICE

TECHNICAL FIELD

The present invention relates to the field of electronic atomization technology, and more particularly to an atomization assembly for use in electromagnetic heating device.

BACKGROUND TECHNOLOGY

Electric heating atomization technology is a new atomization technology emerging recently, and the principle is to generate heat by means of a thermal effect of an electrical resistance of a heating member, and applying the heat to heat and atomize liquid into atomized vapor, having wide applications in medicine, intelligent household electrical appliances, and consumer electronic products.

However, as being constrained by the electrical resistance of the heating member, the material and the structure and size of the heating member are limited and utilization of thermal energy is low.

SUMMARY OF THE INVENTION

The purpose of the present invention is to provide an atomization assembly for use in electromagnetic heating device, which alleviates the technical problems of the known electric heating atomization technology that being constrained by the electrical resistance of a heating member, the material and the structure and size of the heating member are limited and utilization of thermal energy is low.

The present invention provides an atomization assembly for use in electromagnetic heating device, comprising an atomization apparatus and a heating apparatus, the atomization apparatus comprising a first seat body, a magnetically conductive metal part, and a liquid guide part, the first seat body comprising a exhaust channel, a clamping cavity, a plurality of liquid inlets that are arranged transversely, and a liquid storage cavity for storing a liquid, the exhaust channel, the clamping cavity, the liquid inlets, and the liquid storage cavity being sequentially set in communication with each other, the exhaust channel and the clamping cavity being respectively formed by recessing upper and lower ends of the first seat body, the magnetically conductive metal part comprising a first through hole formed by vertically penetrating therethrough and a plurality of interconnected holes that are arranged transversely and are in communication with the first through hole, the magnetically conductive metal part and the liquid guide part being both disposed in the clamping cavity, the clamping cavity being in communication with the exhaust channel, the liquid guide part being of an annular form, the liquid guide part being sleeved outside of the magnetically conductive metal part, the liquid guide part comprising a plurality of clearance holes that function to keep the liquid therein and are in communication with each other, the clearance holes having one end in communication with the interconnected holes and an opposite end in communication with the liquid inlets, the heating apparatus comprising a second seat body, a circuit board, a power battery, and a coil assembly, the power battery, the circuit board, and the coil assembly being fixed in the second seat body, the power battery being connected via the circuit board to the coil assembly, the coil assembly being recessed to form an accommodation space, the first seat body being fixable to the heating apparatus, the magnetically conductive metal part being located in the accommodation space.

Further, a top of the second seat body is recessed to form a retention trough, the coil assembly being fixed in the retention trough, one end of the first seat body in which the magnetically conductive metal part is disposed is insertable into the accommodation space.

Further, the first seat body comprises a liquid storage housing and an underframe, the liquid storage housing comprising a mouth piece that comprises the exhaust channel and a sleeve being sleeved outside of the mouth piece, the sleeve having one end connected to an outside wall of the mouth piece and an opposite end being spaced apart from the mouth piece, the underframe comprising a bottom cover that comprises an accommodation chamber and a support seat that protrudes from a bottom wall of the accommodation chamber, the underframe comprising a second through hole and the plurality of liquid inlets, the second through hole penetrating from a top of the support seat to extend toward a bottom of the bottom cover, the bottom cover being inserted into and retained in the sleeve, the support seat abutting a bottom of the mouth piece, the second through hole being in communication with the first through hole, the liquid inlets being formed in the support seat and are in communication with the second through hole, the liquid guide part being located in the second through hole, an inside wall of the second through hole and a bottom face of the mouth piece jointly surrounding and delimiting the clamping cavity, an inside wall of the accommodation chamber, the outside wall of the support seat, the outside wall of the mouth piece, and an inside wall of the sleeve jointly surrounding and delimiting the liquid storage cavity.

Further, the atomization apparatus further comprises a silicone seat, the silicone seat being of an annular form, the silicone seat being sleeved outside of the support seat and located in the liquid storage cavity, an end of an outside wall of the silicone seat being in contact with the inside wall of the sleeve and forming sealed connection with the sleeve, an opposite end of the outside wall of the silicone seat being in contact with an inside wall of the bottom cover and forming sealed connection with the bottom cover.

Further, the magnetically conductive metal part comprises a magnetically conductive tube and two retention plates that are arranged opposite to each other, the liquid guide part being sleeved outside of the magnetically conductive tube, the interconnected holes and the first through hole being formed in the magnetically conductive tube, the retention plate having one end connected to one end of the magnetically conductive tube that is distant from the mouth piece and an opposite end retained on the liquid guide part.

Further, the atomization apparatus further comprises a sealing gasket, the sealing gasket being of an annular form, the sealing gasket being clamped between the mouth piece and the support seat.

Further, the coil assembly comprises a supporting frame and an annular coil wound in an annular form, the supporting frame comprising a straight barrel and a first transverse board, the first transverse board being fixed to an inside wall of the straight barrel at an end that is distant from the mouth piece, the straight barrel and the first transverse board jointly surrounding and delimiting the accommodation space, the annular coil being sleeved outside of the wall of the straight barrel, the annular coil being located between the outside wall of the straight barrel and an inside wall of the retention trough, the annular coil being connected with the circuit board.

Further, the heating apparatus further comprises a bottom casing, and the second seat body comprises a power frame and a heating case, the heating case being of an annular form, the circuit board, the power battery, and the power frame being located in the heating case, the power frame comprising, arranged and connected in sequence from top to bottom, a second transverse board, a frame, and a base, the base comprising a disposition chamber, the power battery being retained in the disposition chamber, the circuit board being fixed on the frame, the frame being in contact engagement with the coil assembly, the bottom casing being mounted on the heating case and in contact engagement with the base, the second transverse board and an inside wall of the heating case jointly surrounding and delimiting the retention trough.

Further, the heating apparatus further comprises a plurality of temperature detectors, the second transverse board being formed with a plurality of third through holes vertically penetrating therethrough, the first transverse board being formed with a plurality of retention holes vertically penetrating therethrough, the temperature detectors having one end retained in the retention holes and located in the clamping cavity and an opposite end extending through the third through holes to connect with the circuit board.

Further, the heating apparatus further comprises a gas inlet passage, the power frame and the heating case being arranged to be spaced apart from each other, the bottom casing being formed with a plurality of first gas inlet openings penetrating therethrough, the frame being rectangular in shape, the second transverse board being further formed with a plurality of second gas inlet openings penetrating therethrough, the first transverse board being further formed with a plurality of third gas inlet openings penetrating therethrough, the first gas inlet openings, spacing between the power frame and the heating case, the second gas inlet openings, the third gas inlet openings, and the clamping cavity being sequentially set in communication with one another, the first gas inlet openings, the spacing between the power frame and the heating case, the second gas inlet openings, and the third gas inlet openings jointly forming the gas inlet passage.

Compared with the prior art, efficacy of the present invention is as follows:

In the present invention, the power battery supplies electricity through the circuit board to the coil assembly so as to cause the coil assembly to generate an alternate magnetic field. When the magnetically conductive metal part is located in the alternate magnetic field, surfaces of the magnetically conductive metal part cut the alternate magnetic field to generate an alternate current. The current makes carriers of the magnetically conductive metal part move irregularly at a high speed to generate thermal energy. Liquid in the liquid guide part is converted into gas to discharge through the exhaust channel. The present invention applies power battery heating to the electronic atomization field, and the magnetically conductive metal part requires no conductive lines connected thereto and the arrangement of heat zones of the magnetically conductive metal part does not need to be made according to the electrical resistance of the magnetically conductive metal part, and both the structural strength and the material of the magnetically conductive metal part can be made with an optimal design and the utilization of thermal energy is made high.

Figure 1:
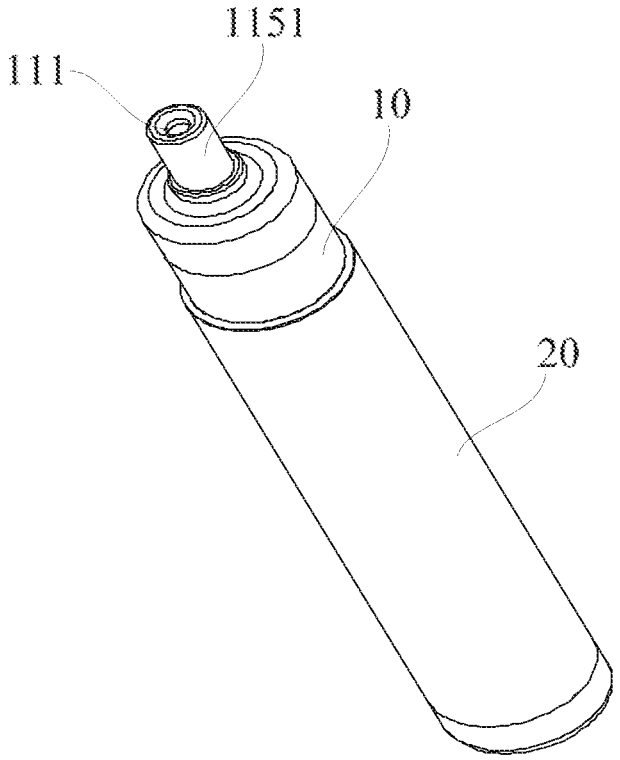
FIG. 1 is a schematic view showing an atomization assembly for use in electromagnetic heating device according to an embodiment of the present invention.
Figure 2:
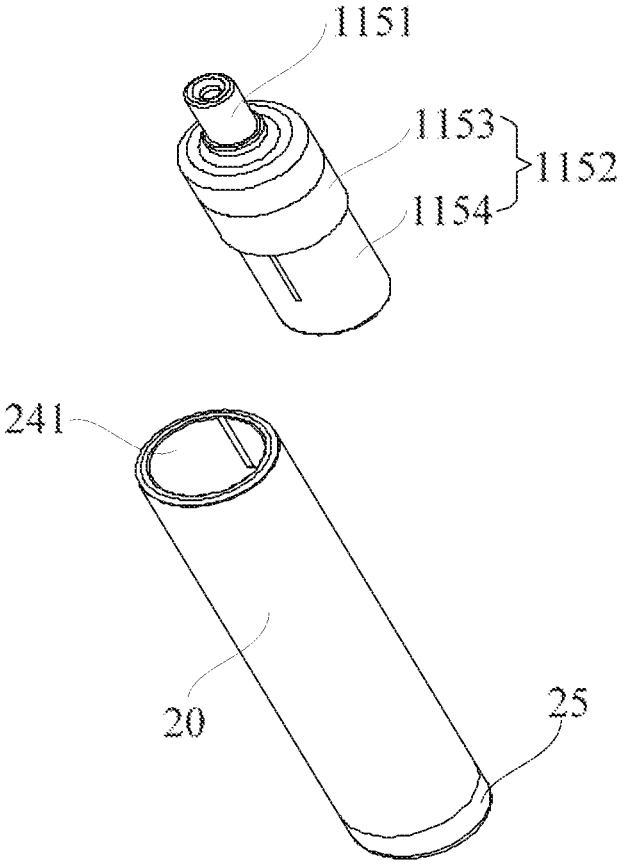
FIG. 2 is an exploded view showing the atomization assembly for use in electromagnetic heating device according to the embodiment of the present invention.
Figure 3:
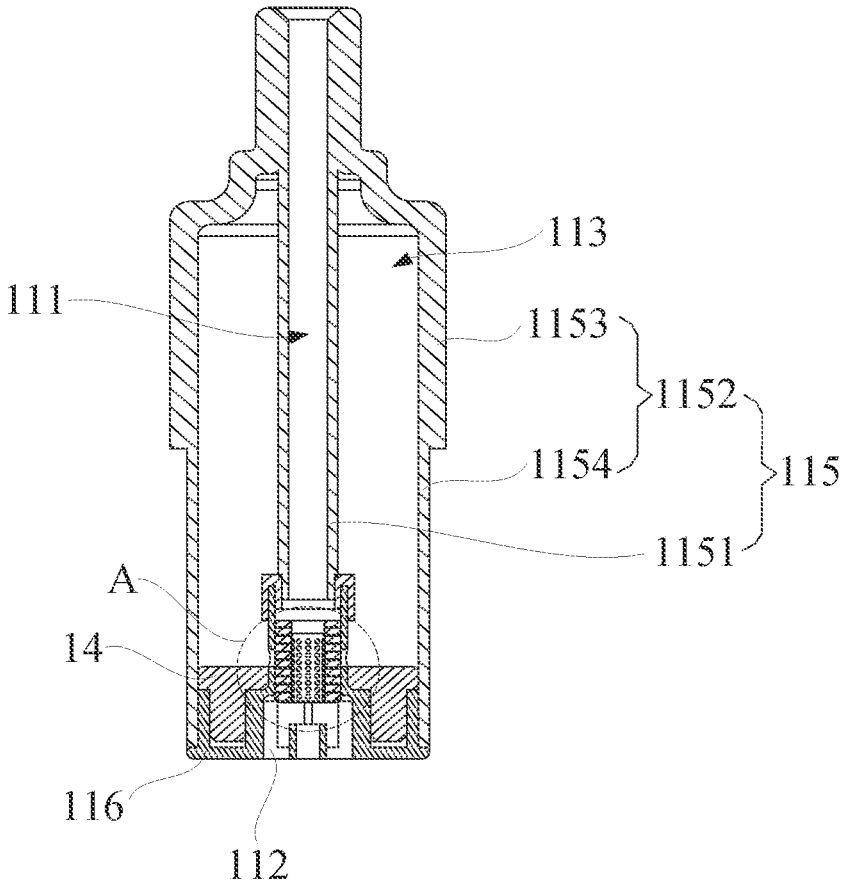
FIG. 3 is a cross-sectional view showing an atomization apparatus according to the embodiment of the present invention.
Figure 4:
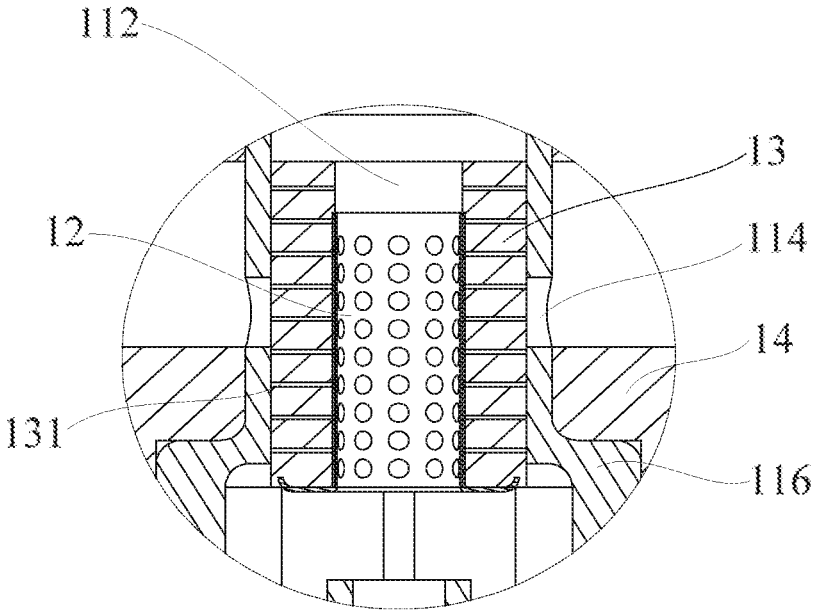
FIG. 4 is an enlarged view of portion A of FIG. 3.

10, atomization apparatus; 11, first seat body; 111, exhaust channel; 112, clamping cavity; 113, liquid storage cavity; 114, liquid inlet; 115, liquid storage housing; 1151, mouth piece; 1152, sleeve; 1153, first tubular body; 1154, second tubular body; 116, underframe; 1161, bottom cover; 1162, accommodation chamber; 1163, support seat; 1164, second through hole; 1165, isolation block; 1166, conducting hole; 12, magnetically conductive metal part; 121, first through hole; 122, interconnected hole; 123, magnetically conductive tube, 124, retention plate; 13, liquid guide part; 131, clearance hole; 14, silicone seat; 15, sealing gasket; 20, heating apparatus; 21, second seat body; 211, retention trough; 212, power frame; 2121, second transverse board; 2122, frame; 2123, base; 2124, disposition chamber; 2125, third through hole; 2126, second gas inlet opening; 213, heating case; 22, circuit board; 23, power battery; 24, coil assembly; 241, accommodation space; 242, supporting frame; 2421, straight barrel; 2422, first transverse board; 2423, retention hole; 2424, third gas inlet opening; 243, annular coil; 25, bottom casing; 251, first gas inlet opening; 252, fifth through hole; 26, temperature detector; 27, gas inlet passage; 28, charging socket; 29, sealing block; 291, fourth through hole; 292, fourth gas inlet opening.

DETAILED DESCRIPTION OF PREFERRED EMBODIMENTS OF THE INVENTION

In the following, reference is made to the attached drawings and embodiments to describe the present invention in detail. It is noted that, provided there is no confliction, combination can be arbitrarily made among each of the embodiments or each of the technical features illustrated below to form new embodiments.

Referring to FIGS. 1-8, the present invention discloses an atomization assembly for use in an electromagnetic heating device, comprising an atomization apparatus 10 and a heating apparatus 20. The atomization apparatus 10 and the heating apparatus 20 are of a separable arrangement with respect to structures thereof, and the atomization apparatus 10 is inserted into and retained in one end of the heating apparatus 20.

In the instant embodiment, the atomization apparatus 10 comprises a first seat body 11, a magnetically conductive metal part 12, and a liquid guide part 13. The liquid guide part 13 can be made of liquid-conducting cotton, or a fiber-based organic material, or a porous ceramic based inorganic material. The liquid guide part 13 comprises, in an interior thereof, with a plurality of clearance holes 131, and liquid may penetrate from one of the clearance holes 131 to another one of the clearance holes 131. These clearance holes 131 are set in mutual communication with one another. The first seat body 11 includes an exhaust channel 111, a clamping cavity 112, a liquid storage cavity 113, and a plurality of liquid inlets 114. The liquid inlets 114 are arranged transversely. The liquid storage cavity 113 functions for storing liquid. The exhaust channel 111, the clamping cavity 112, the liquid inlets 114, and the liquid storage cavity 113 are sequentially set in communication with each other. The exhaust channel 111 and the clamping cavity 112 are respectively formed by recessing upper and lower end surfaces of the first seat body 11 and are in communication with each other. An inside diameter of the clamping cavity 112 is greater than an inside diameter of the exhaust channel 111.

The magnetically conductive metal part 12 includes a first through hole 121 and a plurality of interconnected holes 122. The first through hole 121 is extended vertically to penetrate in a length direction of the magnetically conductive metal part 12. The magnetically conductive metal part 12 and the liquid guide part 13 are both disposed in an interior of the clamping cavity 112. The first through hole 121 is in communication with the exhaust channel 111. The plurality of interconnected holes 122 are arranged transversely. The interconnected holes 122 are in communication with the first through hole 121. The liquid guide part 13 is made in an annular form. The liquid guide part 13 is sleeved outside of the magnetically conductive metal part 12. The clearance holes 131 of the liquid guide part 13 have one end in communication with the interconnected holes 122 and an opposite end in communication with the liquid inlets 114. Liquid passes through the liquid inlets 114 to get into the clearance boles 131 of the liquid guide part 13 and stays therein, and the liquid guide part 13 may use the clearance holes 131 thereof to transfer and store the liquid.

Referring further to FIGS. 9-13, the heating apparatus 20 comprises a second seat body 21, circuit boards 22, a power battery 23, and a coil assembly 24. The power battery 23, the circuit boards 22, and the coil assembly 24 are all fixed in the second seat body 21. The power battery 23 are connected through the circuit boards 22 to the coil assembly 24. The coil assembly 24 is recessed to form an accommodation space 241. The first seat body 11 is fixable to the heating apparatus 20, and the magnetically conductive metal part 12 is located in the accommodation space 241, and the magnetically conductive metal part 12 gets into contact with liquid through the liquid guide part 13. The magnetically conductive metal part 12 is generally made of materials, such as iron and iron alloy. Since the liquid can be selected as a cigarette liquid, the magnetically conductive metal part 12 is required to be environmentally friendly and food grade and may generally use ferrite iron and stainless steel series, or other metallic materials of which surfaces have been treated with a coating for environmental friendliness and temperature resistance.

The power battery 23 supplies electricity through the circuit boards 22 to the coil assembly 24. The circuit board 22 may include built-in procedures to cause the coil assembly 24 to generate an alternate magnetic field, and the surfaces of the magnetically conductive metal part 12 cut the alternate magnetic field to generate an alternate current. The current makes carriers of the magnetically conductive metal part 12 move irregularly at a high speed to generate thermal energy. The liquid flows from the liquid storage cavity 113, through the liquid inlets 114, and flows into the clearance holes 131 of the liquid guide part 13 to store therein. After the magnetically conductive metal part 12 is heated up, the liquid in the liquid guide part 13 is converted into gas to move into the interconnected holes 122. The interconnected holes 122 are primarily for allowing vapor that is generated by a portion of the liquid that is heated and atomized at a location of being in contact with the magnetically conductive metal part 12 to emerge through the interconnected holes 122 to thus pass through the interconnected holes 122 and then discharge through the exhaust channel 111.

A top of the second seat body 21 is recessed to form a retention trough 211, and the coil assembly 24 is fixed in the retention trough 211. In a separate condition, the accommodation space 241 is set to face one side of the first seat body 11, and one end of the first seat body 11 in which the magnetically conductive metal part 12 is disposed is insertable into the accommodation space 241, and in the process of use, the atomization apparatus 10 is inserted and retained in the accommodation space 241 of the heating apparatus 20.

In the instant embodiment, the first seat body 11 comprises a liquid storage housing 115 and an underframe 116. The liquid storage housing 115 comprises a mouth piece 1151 and a sleeve 1152. The mouth piece 1151 includes the exhaust channel 111. The sleeve 1152 is sleeved over an outside wall of the mouth piece 1151. The mouth piece 1151 is of an elongate form and is arranged vertically. The exhaust channel 111 extends in a length direction of the mouth piece 1151 to penetrate the entirety of the mouth piece 1151. The sleeve 1152 has one end connected to the outside wall of the mouth piece 1151 at a middle thereof and an opposite end arranged to be spaced apart from the mouth piece 1151.

The underframe 116 comprises a bottom cover 1161 and a support seat 1163. The bottom cover 1161 includes an accommodation chamber 1162. The support seat 1163 is arranged on the accommodation chamber 1162 and protruding from a bottom wall of the accommodation chamber 1162. The underframe 116 includes a second through hole 1164 and the plurality of liquid inlets 114. The second through hole 1164 penetrates from a top of the support seat 1163 to extend toward a bottom of the bottom cover 1161. The bottom cover 1161 is inserted into and retained in the sleeve 1152, and the support seat 1163 abuts a bottom of the mouth piece 1151. The second through hole 1164 is in communication with the first through hole 121. The liquid inlets 114 are formed in the support seat 1163 and are in communication with the second through hole 1164. The liquid guide part 13 is located in the second through hole 1164. The second through hole 1164 is of a step-like form for adjusting a location where the liquid guide part 13 and the magnetically conductive metal part 12 are disposed. An inside wall of the second through hole 1164 and a bottom face of the mouth piece 1151 jointly surround and delimit the clamping cavity 112. An inside wall of the accommodation chamber 1162, an outside wall of the support seat 1163, the outside wall of the mouth piece 1151, and an inside wall of the sleeve 1152 jointly surround and delimit the liquid storage cavity 113.

The atomization apparatus 10 further comprises a silicone seat 14. The silicone seat 14 is of an annular form. The silicone seat 14 is sleeved outside of the support seat 1163 and is located in the liquid storage cavity 113. An end of an outside wall of the silicone seat 14 is in contact engagement with the inside wall of the sleeve 1152 and forms sealed connection with the sleeve 1152. An opposite end of the outside wall of the silicone seat 14 is in contact engagement with an inside wall of the bottom cover 1161 and forms sealed connection with the bottom cover 1161 to prevent liquid leaking through a joint between the sleeve 1152 and the bottom cover 1161. A distance from a top of the silicone seat 14 to a bottom of the underframe 116 is less than a distance from a bottom of the liquid inlets 114 that are arranged transversely to the bottom of the underframe 116, meaning the silicone seat 14 does not shield and block the liquid inlets 114.

The sleeve 1152 comprises a first tubular body 1153 and a second tubular body 1154 that is arranged coaxial with the first tubular body 1153. The first tubular body 1153 and the second tubular body 1154 are both in an annular form. The first tubular body 1153 has one end that is bent to connect to the middle position of the outside wall of the mouth piece 1151 and an opposite end that is connected to the second tubular body 1154. An outside diameter of the second tubular body 1154 is less than an outside diameter of the first tubular body 1153, and outside walls of the first tubular body 1153 and the second tubular body 1154 define a step therebetween. The second tubular body 1154 is located in the accommodation space 241, and the coil assembly 24 is positioned against the step in order to set and limit an axial distance between the atomization apparatus 10 and the heating apparatus 20. The second tubular body 1154 is spaced apart from the mouth piece 1151.

The magnetically conductive metal part 12 comprises a magnetically conductive tube 123 and two retention plates 124 that are arranged opposite to each other. The liquid guide part 13 is sleeved outside of the magnetically conductive tube 123, and the liquid guide part 13 is set in contact with the bottom of the mouth piece 1151. The interconnected holes 122 and the first through hole 121 are formed in the magnetically conductive tube 123. The retention plates 124 have one end that is connected to one end of the magnetically conductive tube 123 distant from the mouth piece 1151 and an opposite end retained on the liquid guide part 13. The liquid guide part 13 is generally set in contact engagement with the magnetically conductive tube 123. The magnetically conductive tube 123 is formed of an annular structure, and such a structure has a better structural strength. Of course, the magnetically conductive tube 123 is not necessary to be of annular structure. A wall of the magnetically conductive tube 123 should not be of an excessive thickness and the thickness is generally less than 0.5 mm. An excessively thick metal surface is not reachable for the liquid and is an ineffective atomization zone, and may cause waste of resources and may also cause a relatively high metal temperature, leading to generation of harmful substances.

As a preferred way of implementation, the atomization apparatus 10 further comprises a sealing gasket 15, and the sealing gasket 15 is made of a silicone rubber material. The sealing gasket 15 is clamped between the mouth piece 1151 and the support seat 1163 to prevent liquid leaking at a joint between the mouth piece 1151 and the support seat 1163.

The coil assembly 24 comprises a supporting frame 242 and an annular coil 243 that is wound to exhibit an annular shape. The supporting frame 242 comprises a straight barrel 2421 and a first transverse board 2422. The first transverse board 2422 is fixed to an inside wall of the straight barrel 2421 at an end that is distant from the mouth piece 1151. The straight barrel 2421 and the first transverse board 2422 jointly surround and delimit the accommodation space 241. The annular coil 243 is sleeved outside of the wall of the straight barrel 2421, and the annular coil 243 is located between the outside wall of the straight barrel 2421 and an inside wall of the retention trough 211. The annular coil 243 is connected with the circuit boards 22. The annular coil 243 is made of a material that is formed of a copper-made enameled wire, which exhibits better electrical conduction performance and has an excellent insulating surface and excellent temperature resistance. The enameled wire can be a rounded wire, or it can be a flat wire for saving space. In certain high-end products, sliver may be used as the conductor, having smaller electrical resistivity, reduced internal resistance, and being not easy to generate heat in the coil. The annular coil 243 is wound around the supporting frame 242.

The supporting frame 242 is generally made of a plastic material and should not include a magnetically conductive metallic material. The supporting frame 242 has an interior space that is of a hollowed configuration, and the accommodation space 241 is arranged in the interior of the supporting frame 242. The accommodation space 241 is the alternate magnetic field zone, and the magnetically conductive metal part 12 that is heated must be in this zone. The annular coil 243 is wound, in a helical form, on the supporting frame 242, having a generally consistent helical pitch. An insulation layer is arranged on a surface of the annular coil 243 to prevent a short-circuit.

The heating apparatus 20 further comprises a bottom casing 25, and the second seat body 21 comprises a power frame 212 and a heating case 213. The heating case 213 is of an annular form. The circuit boards 22, the power battery 23, and the power frame 212 are located in an interior of the heating case 213. The power frame 212 comprises, arranged and connected in sequence from top to bottom, a second transverse board 2121, a frame 2122, and a base 2123. The base 2123 includes a disposition chamber 2124, and the power battery 23 is retained in the disposition chamber 2124. The circuit boards 22 are fixed on the frame 2122. The frame 2122 is rectangular. Either one of the frame 2122 and the second transverse board 2121 can be set in contact engagement with the coil assembly 24, and in the instant embodiment, the frame 2122 is set in contact engagement with the coil assembly 24. The bottom casing 25 is mounted on the heating case 213 and is in contact engagement with the base 2123. The second transverse board 2121 and an inside wall of the heating case 213 jointly surround and delimit the retention trough 211.

As a preferred way of implementation, the heating apparatus 20 further comprises a plurality of temperature detectors 26. The second transverse board 2121 is formed with a plurality of third through holes 2125 vertically penetrating therethrough, and the first transverse board 2422 is formed with a plurality of retention holes 2423 vertically penetrating therethrough. The temperature detectors 26 have one end retained in the retention holes 2423 and located in the clamping cavity 112 and an opposite end extending through the third through holes 2125 to connect with the circuit boards 22. The temperature detector 26 are in contact with the magnetically conductive metal part 12 in the atomization apparatus 10 to detect real-time temperatures of the magnetically conductive metal part 12 and to feed temperature data back to the circuit boards 22 for controlling the temperature of the magnetically conductive metal part 12 to prevent an excessively high temperature of the magnetically conductive metal part 12. The temperature detectors 26 are preferably thermistors or thermal couples or a heat-sensitive metallic material that is sensitive to temperature.

The heating apparatus 20 is further formed with a gas inlet passage 27. The power frame 212 and the heating case 213 are arranged to be spaced apart from each other. The bottom casing 25 is penetrated and formed with a plurality of first gas inlet openings 251. The second transverse board 2121 is further penetrated and formed with a plurality of second gas inlet openings 2126. The first transverse board 2422 is further penetrated and formed with a plurality of third gas inlet openings 2424. The first gas inlet openings 251, the spacing between the power frame 212 and the heating case 213, the second gas inlet openings 2126, the third gas inlet openings 2424, and the clamping cavity 112 are sequentially set in communication with each other. The first gas inlet openings 251, the spacing between the power frame 212 and the heating case 213, the second gas inlet openings 2126, and the third gas inlet openings 2424 jointly form the gas inlet passage 27. In other words, external gas may sequentially move through the first gas inlet openings 251, the spacing between the power frame 212 and the heating case 213, the second gas inlet openings 2126, and the third gas inlet openings 2424 to then get into the clamping cavity 112.

Figure 5:
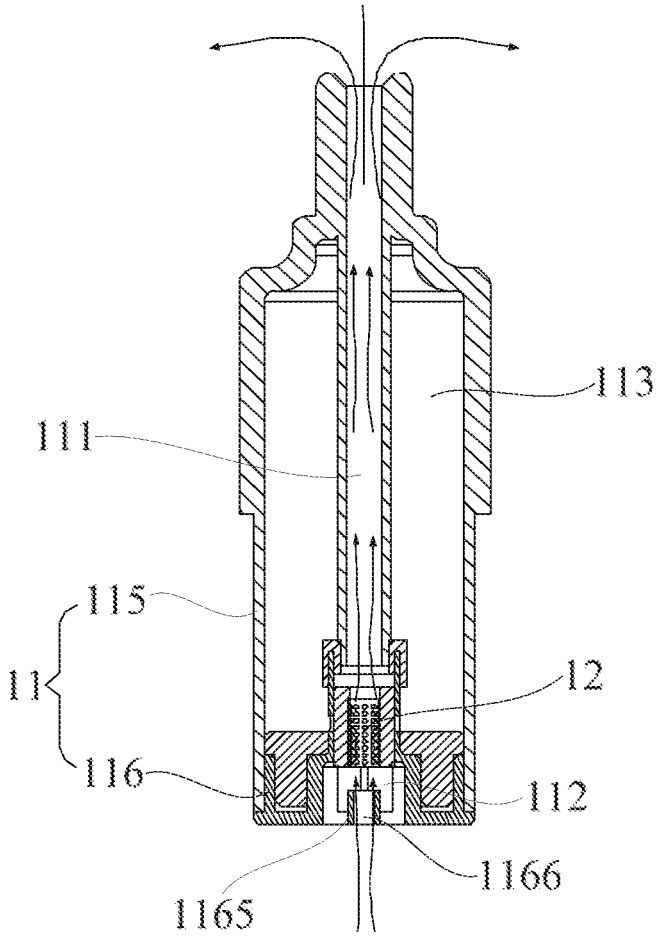
FIG. 5 is a schematic view showing flowing of gas in the atomization apparatus.
Figure 6:
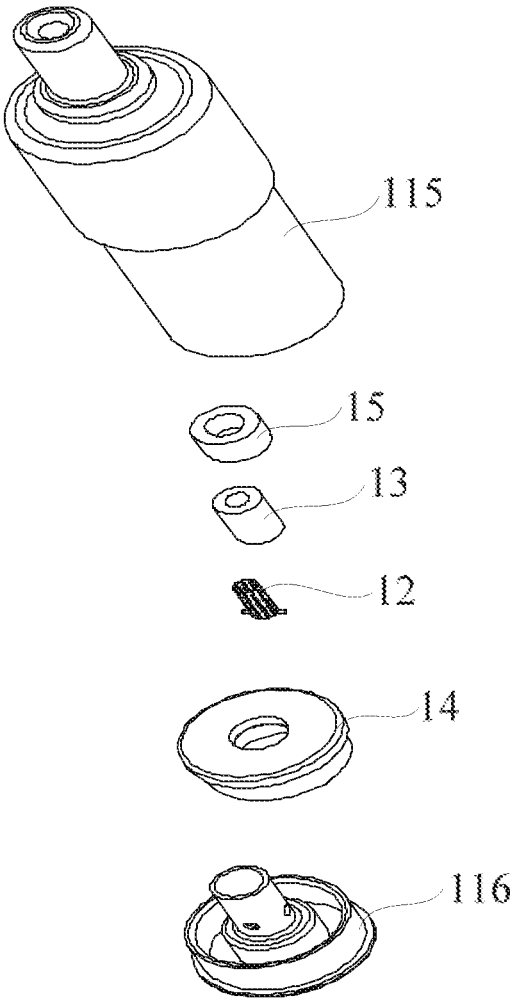
FIG. 6 is an exploded view of the atomization apparatus according to the embodiment of the present invention.
Figure 7:
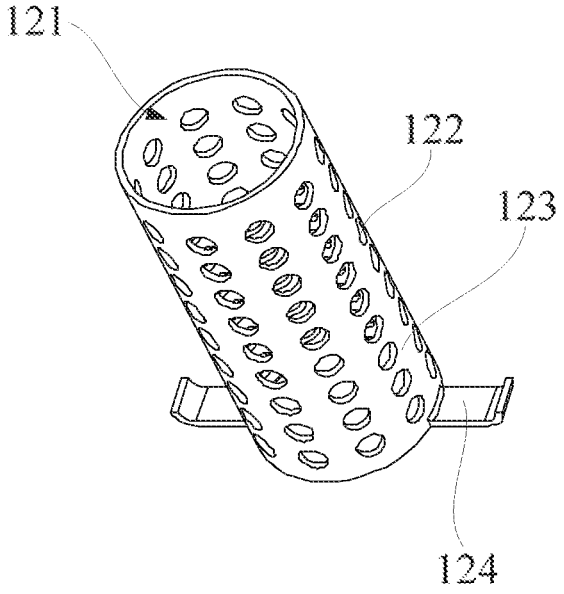
FIG. 7 is a schematic view showing a magnetically conductive metal part according to the embodiment of the present invention.
Figure 8:
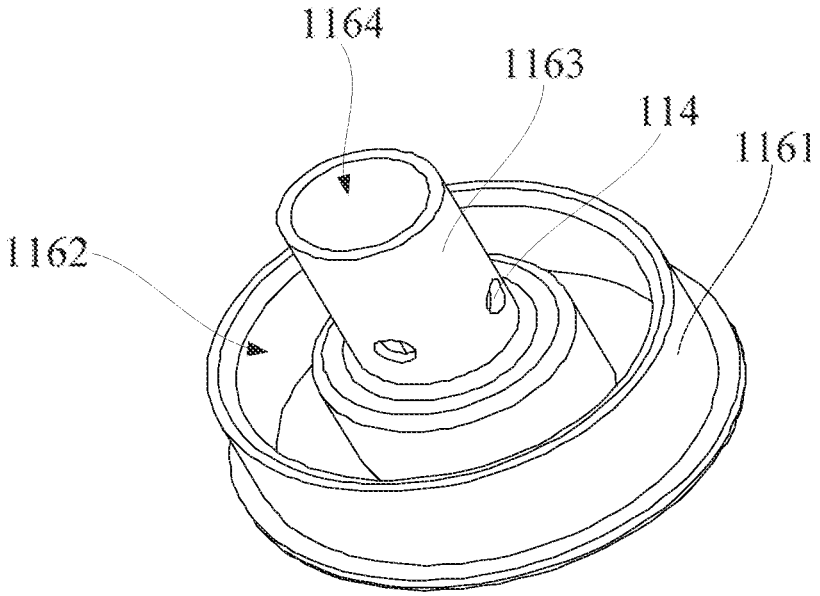
FIG. 8 is a schematic view showing an underframe according to the embodiment of the present invention.
Figure 9:
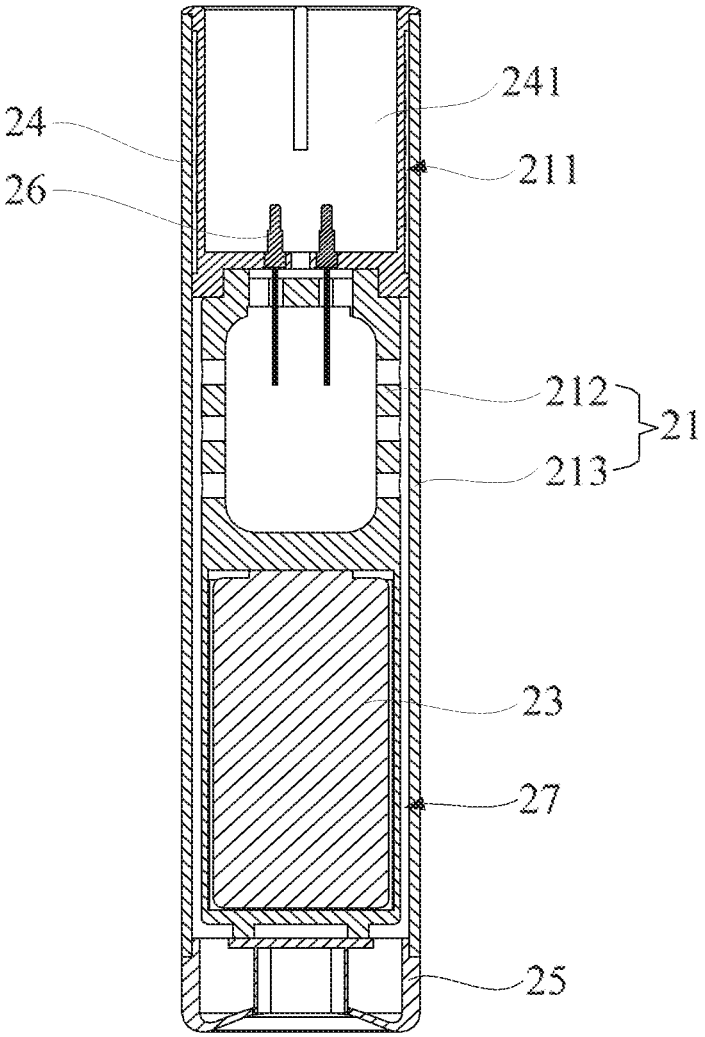
FIG. 9 is a cross-sectional view showing a heating apparatus according to the embodiment of the present invention.
Figure 10:
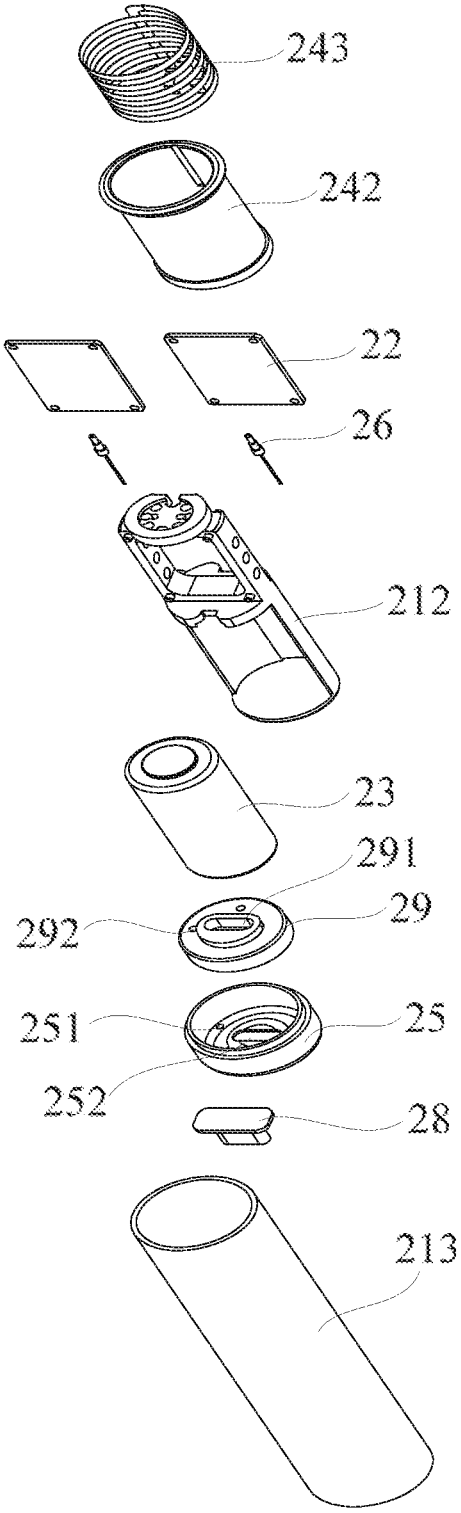
FIG. 10 is an exploded view showing the heating apparatus according to the embodiment of the present invention.
Figure 11:
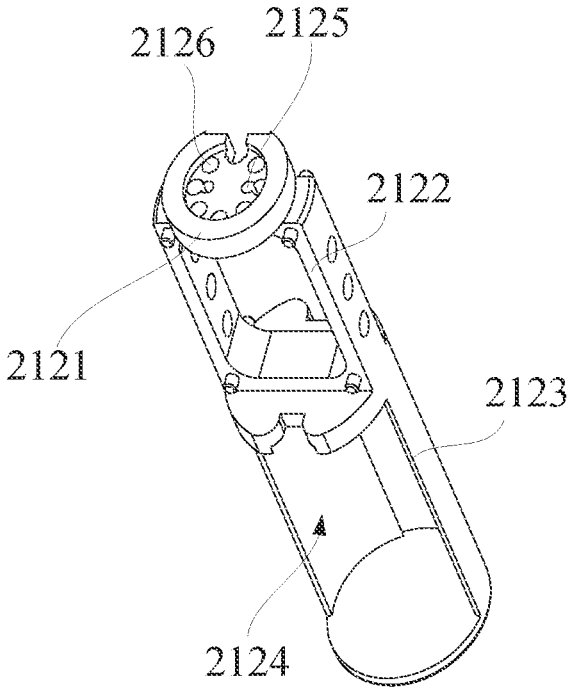
FIG. 11 is a schematic view showing a power frame according to the embodiment of the present invention.
Figure 12:
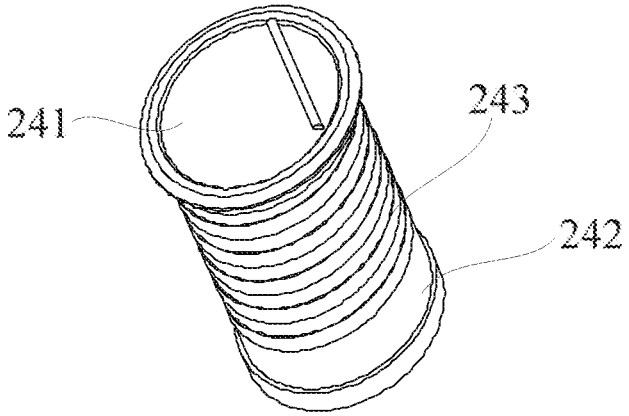
FIG. 12 is a schematic view showing a coil assembly according to the embodiment of the present invention.
Figure 13:
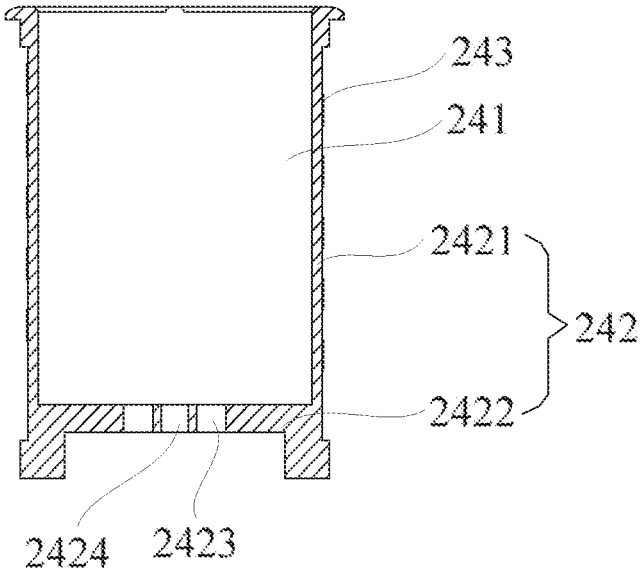
FIG. 13 is a cross-sectional view showing the coil assembly according to the embodiment of the present invention.

Gas enters through the clamping cavity 112 that is located at the bottom, and is blocked by the bottom of the liquid storage cavity 113 to spread to the periphery. The gas passes through the surface of the magnetically conductive metal part 12 and is mixed with atomized vapor that is heated and vaporized by the magnetically conductive metal part 12 to form an aerosol substance, which passes through the first through hole 121 to get into the exhaust channel 111, and is then vaped by a user through the exhaust channel 111. The direction indicated by arrows shown in FIG. 5 is the flowing direction of the gas.

As a preferred way of implementation, the underframe 116 further comprises an isolation block 1165 and a plurality of connecting bars. The isolation block 1165 and the connecting bars are both located in the second through hole 1164. The isolation block 1165 and the magnetically conductive metal part 12 are arranged to be spaced apart from each other. The connecting bar has one end connected to an outside wall of the isolation block 1165 and an opposite end connected to an inside wall of the second through hole 1164. A bottom of the isolation block 1165 is set in contact engagement with a top of the first transverse board 2422. The isolation block 1165 is vertically penetrated and formed with a conducting hole 1166. The conducting hole 1166 is in communication with the third gas inlet openings 2424. The isolation block 1165 functions to prevent, during operation of the atomization assembly for use in electromagnetic heating device, liquid dropping down from the liquid guide part 13 from passing through the third gas inlet openings 2424 to flow into the heating apparatus 20, and similarly, external gas first passes through the third gas inlet openings 2424 and the conducting hole 1166 to then move into the clamping cavity 112.

As a preferred way of implementation, the heating apparatus 20 further comprises a charging socket 28. The charging socket 28 is mounted on the bottom casing 25. The charging socket 28 is connected, via a conductor line, to the circuit boards 22 for charging of the power battery 23.

As a preferred way of implementation, the heating apparatus 20 further comprises a sealing block 29. The sealing block 29 is mounted between the bottom casing 25 and the power frame 212. The sealing block 29 is penetrated and formed with a fourth through hole 291 and a plurality of fourth gas inlet openings 292 that are arranged around a periphery of the fourth through hole 291. The bottom casing 25 is further penetrated and formed with a fifth through hole 252 that is spaced apart from the first gas inlet openings 251. The charging socket 28 has one end fixed to the sealing block 29 and an opposite end extending through the fourth through hole 291 to reach into an interior of the fifth through hole 252. The charging socket 28 and the power battery 23 are connected, and one end of an outside wall of the sealing block 29 is set in contact engagement with an inside wall of the heating case 213, and an opposite end of the outside wall of the sealing block 29 is set in contact engagement with an inside wall of the bottom casing 25 so as to form sealed connection between the heating case 213 and the bottom casing 25. The fourth gas inlet openings 292 have one end in communication with the first gas inlet openings 251 and an opposite end is in communication with the spacing between the power frame 212 and the heating case 213. The fourth gas inlet opening 292 forms a part of the gas inlet passage 27.

Principle of operation of the atomization assembly for use in electromagnetic heating device is as follows:

The liquid storage cavity 113 of the atomization apparatus 10 is filled up with the liquid and the upper end is sealed with the sealing gasket 15. The liquid to be atomized is stored in the liquid storage cavity 113. The underframe 116 is formed with the plurality of liquid inlets 114 to allow the liquid to communicate with the outside. The liquid guide part 13 is arranged outside of the liquid inlets 114. The liquid guide part 13 is provided, in the interior thereof, with the clearance holes 131 to store and transfer the liquid. The magnetically conductive metal part 12 is provided on the inside wall of the liquid guide part 13, and the magnetically conductive metal part 12 functions as a carrier material for electromagnetic induction heating.

A portion of the atomization apparatus 10 is placed in the alternate magnetic field zone of the heating apparatus 20. When a control circuit detects a vaping signal, the circuit boards 22 are activated to operate, and the annular coil 243 generates an alternate magnetic field. Eddy currents are induced on the magnetically conductive metal part 12 to fulfill fast heating. The heat vaporizes the liquid in the liquid guide part 13 into atomized vapor to mix with air entering through the gas inlet passage 27 to form an aerosol substance to be vaped by the user. When the control circuit does not detect the vaping signal, the circuit boards 22 stop operating and the magnetically conductive metal part 12 no longer generates heat.

The atomization assembly for use in electromagnetic heating device according to the present invention converts a direct current into a high-frequency and high-voltage current, and the current flow through the annular coil 243 to generate an alternate magnetic field. Magnetic lines of the magnetic field pass through the magnetically conductive metal part 12 and induce an intense eddy current. The magnetically conductive metal part 12 can fast generate heat by itself.

The atomization apparatus 10 and the heating apparatus 20 are of a separable arrangement with respect to structures thereof. The heating apparatus 20, due to including components, such as the power battery 23 and the circuit boards 22, arranged therein, is of a high cost and is thus made repeatedly usable, while the atomization apparatus 10 contains cigarette liquids that may be of various flavors and is considered consumable and disposable, and is made for contact with human bodies, and the cigarette liquid contained therein or the liquid guide part 13 will loss function after use for an extended period of time, the atomization apparatus 10 is thus considered disposable and must be replaced with a new one after the cigarette liquid contained therein is consumed up.

The embodiments described above are only concerned with the preferred ways of implementation of the present invention and are not intended to limit the scope of protection for the present invention. All non-substantive variations and substitutes that skilled artisans of this field may contemplate on the basis of the present invention are considered falling the scope of protection that the present invention pursues.

What is claimed is:

1. An atomization assembly for use in electromagnetic heating device, characterized by comprising an atomization apparatus and a heating apparatus, the atomization apparatus comprising a first seat body, a magnetically conductive metal part, and a liquid guide part, the first seat body comprising a exhaust channel, a clamping cavity, a plurality of liquid inlets that are arranged transversely, and a liquid storage cavity for storing a liquid, the exhaust channel, the clamping cavity, the liquid inlets, and the liquid storage cavity being sequentially set in communication with each other, the exhaust channel and the clamping cavity being respectively formed by recessing upper and lower ends of the first seat body, the magnetically conductive metal part comprising a first through hole formed by vertically penetrating therethrough and a plurality of interconnected holes that are arranged transversely and are in communication with the first through hole, the magnetically conductive metal part and the liquid guide part being both disposed in the clamping cavity, the clamping cavity being in communication with the exhaust channel, the liquid guide part being of an annular form, the liquid guide part being sleeved outside of the magnetically conductive metal part, the liquid guide part comprising a plurality of clearance holes that function to keep the liquid therein and are in communication with each other, the clearance holes having one end in communication with the interconnected holes and an opposite end in communication with the liquid inlets, the heating apparatus comprising a second seat body, a circuit board, a power battery, and a coil assembly, the power battery, the circuit board, and the coil assembly being fixed in the second seat body, the power battery being connected via the circuit board to the coil assembly, the coil assembly being recessed to form an accommodation space, the first seat body being fixable to the heating apparatus, the magnetically conductive metal part being located in the accommodation space;

wherein a top of the second seat body is recessed to form a retention trough, the coil assembly being fixed in the retention trough, one end of the first seat body in which the magnetically conductive metal part is disposed is insertable into the accommodation space; and wherein the first seat body comprises a liquid storage housing and an underframe, the liquid storage housing comprising a mouth piece that comprises the exhaust channel and a sleeve being sleeved outside of the mouth piece, the sleeve having one end connected to an outside wall of the mouth piece and an opposite end being spaced apart from the mouth piece, the underframe comprising a bottom cover that comprises an accommodation chamber and a support seat that protrudes from a bottom wall of the accommodation chamber, the underframe comprising a second through hole and the plurality of liquid inlets, the second through hole penetrating from a top of the support seat to extend toward a bottom of the bottom cover, the bottom cover being inserted into and retained in the sleeve, the support seat abutting a bottom of the mouth piece, the second through hole being in communication with the first through hole, the liquid inlets being formed in the support seat and are in communication with the second through hole, the liquid guide part being located in the second through hole, an inside wall of the second through hole and a bottom face of the mouth piece jointly surrounding and delimiting the clamping cavity, an inside wall of the accommodation chamber, the outside wall of the support seat, the outside wall of the mouth piece, and an inside wall of the sleeve jointly surrounding and delimiting the liquid storage cavity.

2. The atomization assembly for use in electromagnetic heating device according to claim 1, characterized in that the atomization apparatus further comprises a silicone seat, the silicone seat being of an annular form, the silicone seat being sleeved outside of the support seat and located in the liquid storage cavity, an end of an outside wall of the silicone seat being in contact with the inside wall of the sleeve and forming sealed connection with the sleeve, an opposite end of the outside wall of the silicone seat being in contact with an inside wall of the bottom cover and forming sealed connection with the bottom cover.

3. The atomization assembly for use in electromagnetic heating device according to claim 1, characterized in that the magnetically conductive metal part comprises a magnetically conductive tube and two retention plates that are arranged opposite to each other, the liquid guide part being sleeved outside of the magnetically conductive tube, the interconnected holes and the first through hole being formed in the magnetically conductive tube, the retention plate having one end connected to one end of the magnetically conductive tube that is distant from the mouth piece and an opposite end retained on the liquid guide part.

4. The atomization assembly for use in electromagnetic heating device according to claim 1, characterized in that the atomization apparatus further comprises a sealing gasket, the sealing gasket being of an annular form, the sealing gasket being clamped between the mouth piece and the support seat.

5. The atomization assembly for use in electromagnetic heating device according to claim 1, characterized in that the coil assembly comprises a supporting frame and an annular coil wound in an annular form, the supporting frame comprising a straight barrel and a first transverse board, the first transverse board being fixed to an inside wall of the straight barrel at an end that is distant from the mouth piece, the straight barrel and the first transverse board jointly surrounding and delimiting the accommodation space, the annular coil being sleeved outside of the wall of the straight barrel, the annular coil being located between the outside wall of the straight barrel and an inside wall of the retention trough, the annular coil being connected with the circuit board.

6. The atomization assembly for use in electromagnetic heating device according to claim 5, characterized in that the heating apparatus further comprises a bottom casing, and the second seat body comprises a power frame and a heating case, the heating case being of an annular form, the circuit board, the power battery, and the power frame being located in the heating case, the power frame comprising, arranged and connected in sequence from top to bottom, a second transverse board, a frame, and a base, the base comprising a disposition chamber, the power battery being retained in the disposition chamber, the circuit board being fixed on the frame, the frame being in contact engagement with the coil assembly, the bottom casing being mounted on the heating case and in contact engagement with the base, the second transverse board and an inside wall of the heating case jointly surrounding and delimiting the retention trough.

7. The atomization assembly for use in electromagnetic heating device according to claim 6, characterized in that the heating apparatus further comprises a plurality of temperature detectors, the second transverse board being formed with a plurality of third through holes vertically penetrating therethrough, the first transverse board being formed with a plurality of retention holes vertically penetrating therethrough, the temperature detectors having one end retained in the retention holes and located in the clamping cavity and an opposite end extending through the third through holes to connect with the circuit board.

8. The atomization assembly for use in electromagnetic heating device according to claim 6, characterized in that the heating apparatus further comprises a gas inlet passage, the power frame and the heating case being arranged to be spaced apart from each other, the bottom casing being formed with a plurality of first gas inlet openings penetrating therethrough, the frame being rectangular in shape, the second transverse board being further formed with a plurality of second gas inlet openings penetrating therethrough, the first transverse board being further formed with a plurality of third gas inlet openings penetrating therethrough, the first gas inlet openings, spacing between the power frame and the heating case, the second gas inlet openings, the third gas inlet openings, and the clamping cavity being sequentially set in communication with one another, the first gas inlet openings, the spacing between the power frame and the heating case, the second gas inlet openings, and the third gas inlet openings jointly forming the gas inlet passage.

* * * * *